US009232879B2

(12) United States Patent
Schultink et al.

(10) Patent No.: US 9,232,879 B2
(45) Date of Patent: Jan. 12, 2016

(54) RETAINING PLATE FOR A VACUUM CLEANER FILTER BAG

(75) Inventors: Jan Schultink, Overpelt (BE); Ralf Sauer, Overpelt (BE)

(73) Assignee: Eurofilters Holding N.V., Overpelt (BE)

( * ) Notice: Subject to any disclaimer, the term of this patent is extended or adjusted under 35 U.S.C. 154(b) by 324 days.

(21) Appl. No.: 13/497,597

(22) PCT Filed: Sep. 23, 2010

(86) PCT No.: PCT/EP2010/005830

§ 371 (c)(1),
(2), (4) Date: May 8, 2012

(87) PCT Pub. No.: WO2011/035912

PCT Pub. Date: Mar. 31, 2011

(65) Prior Publication Data

US 2012/0211625 A1 Aug. 23, 2012

(30) Foreign Application Priority Data

Sep. 25, 2009 (EP) ..... 09012207

(51) Int. Cl.
*B01D 46/02* (2006.01)
*A47L 9/14* (2006.01)

(52) U.S. Cl.
CPC ..... *A47L 9/1454* (2013.01); *A47L 9/1445* (2013.01)

(58) Field of Classification Search
CPC ... A47L 9/1454; A47L 9/1427; A47L 9/1445; A47L 9/14; A47L 9/1436
USPC ..... 248/200, 99, 101, 95, 213.1, 213.2, 248/226.11; 55/367, 376, 472
See application file for complete search history.

(56) References Cited

U.S. PATENT DOCUMENTS

| | | | | | |
|---|---|---|---|---|---|
| 1,782,064 | A | * | 11/1930 | Gray | 55/367 |
| 3,432,998 | A | * | 3/1969 | Downey | 55/367 |
| 3,724,179 | A | | 4/1973 | Leinfelt | |
| 3,933,451 | A | * | 1/1976 | Johansson | 55/367 |
| 4,861,357 | A | | 8/1989 | Gavin et al. | |
| 5,039,324 | A | * | 8/1991 | Goldberg | 55/367 |
| 5,045,099 | A | * | 9/1991 | Goldberg | 55/367 |

(Continued)

FOREIGN PATENT DOCUMENTS

| | | |
|---|---|---|
| CN | 1150385 A | 5/1997 |
| DE | 69 14 638 | 8/1969 |

(Continued)

OTHER PUBLICATIONS

International Search Report completed Nov. 26, 2010 for International Application No. PCT/EP2010/005830.

*Primary Examiner* — Casandra Davis
(74) *Attorney, Agent, or Firm* — Brinks Gilson & Lione

(57) ABSTRACT

The invention relates to a retaining plate for a vacuum-cleaner filter bag comprising a through-passage opening and a closure flap for closing the through-passage opening, wherein the closure flap comprises a first region comprising a first material of a first hardness and a second region comprising a second material of a second hardness, wherein the second hardness is at a lower level than the first hardness, wherein the second region is arranged, at least in part, on the periphery of the closure flap, and wherein the second material, at least in part, has a thickness of less than 1 mm.

20 Claims, 3 Drawing Sheets

(56) References Cited

U.S. PATENT DOCUMENTS

Figure 1:
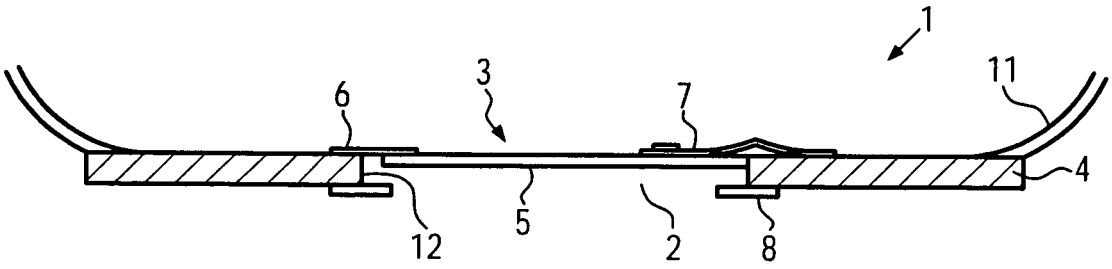

| | | | | | |
|---|---|---|---|---|---|
| 5,226,941 | A | * | 7/1993 | Uibel et al. | 55/367 |
| 5,230,724 | A | * | 7/1993 | Marafante et al. | 55/367 |
| 5,820,643 | A | * | 10/1998 | Lienenluke et al. | 55/367 |

FOREIGN PATENT DOCUMENTS

| | | | |
|---|---|---|---|
| DE | 90 16 893 | U1 | 3/1991 |
| DE | 296 15 163 | U1 | 1/1997 |
| DE | 199 48 909 | A1 | 4/2001 |
| DE | 20 2008 004 733 | U1 | 11/2008 |
| DE | 10 2007 040 417 | A1 | 3/2009 |
| DE | 10 2008 046 200 | A1 | 4/2009 |
| EP | 1 849 392 | A1 | 10/2007 |
| EP | 2 025 278 | A1 | 2/2009 |
| FR | 2 721 188 | A1 | 12/1995 |

* cited by examiner

RETAINING PLATE FOR A VACUUM CLEANER FILTER BAG

This application claims the benefit under 35 U.S.C. §371 of International Application No. PCT/EP2010/005830, filed Sep. 23, 2010, which claims the benefit of European Patent Application No. 09012207.8, filed Sep. 25, 2009, which are incorporated by reference herein in their entirety.

The invention relates to a retaining plate for a vacuum cleaner filter bag with a closure flap.

Vacuum cleaner filter bags usually comprise a retaining plate at the inlet opening into the bag which is provided for retaining the filter bag inside a vacuum cleaner. The openings in these retaining plates can often be closed by means of a closure flap. In the suction operation, the closure flap is in an open position in which the through-passage opening of the retaining plate is opened. When the suction operation is terminated, the closure flap closes.

Conventional retaining plates are known, for example, from DE 296 15 163, DE 199 48 909, DE 20 2008 004 733, or EP 1 849 392.

Such conventional retaining plates have a disadvantage in that in the region of the opening of the retaining plate, dust particles or fibers get deposited. Coarse dust particles or fibers can in particular also be present at the periphery of the opening and prevent the closure flap from completely closing.

In view of these problems, various possibilities have been suggested to improve the vacuum cleaner filter bags. In EP 2 025 278, in the region of the inlet opening, the filter bag material comprises an inner layer, for example of a foil or paper, such that the formation of a filter cake on this area is prevented. From DE 10 2008 046 200, a filter bag is known in which a so-called flow collar is formed on the retaining plate which extends at the inner side of the retaining plate into the inside of the filter bag.

DE 10 2007 040 417 shows a vacuum cleaner filter bag with a retaining plate, wherein in a non-operative state, a closure flap rests on an opening periphery of the opening of the retaining plate in a region of cooperation. The aim is to embody at least 50% or more of the cooperation region of the opening periphery or the periphery of the closure flap of so-called soft plastics having a thickness in the millimeter range (1 to 3 mm). The soft plastic has a Shore hardness of less than 25 Shore A. The soft plastic is embodied to be thick enough for coarse dirt particles to be at least partially pressed into the soft plastic by the action of the closure flap.

In view of prior art, there is a demand for a further improved retaining plate for a vacuum cleaner filter bag with a closure flap which preferably permits the retaining plate opening to be closed even if the bag is relatively full. For this, the invention provides a retaining plate according to claim 1.

According to the invention, a retaining plate for a vacuum cleaner filter bag is provided, comprising a through-passage opening and a closure flap for closing the through-passage opening, wherein the closure flap comprises a first region comprising a first material of a first hardness, and a second region comprising a second material of a second hardness, wherein the second hardness is at a lower level than the first hardness, wherein the second region is arranged, at least in part, on the periphery of the closure flap, and wherein the second material, at least in part, has a thickness of less than 1 mm.

Since in a peripheral region of the closure flap, the softer material comprises a small thickness of less than 1 mm, the closure flap can still move through the formed filter cake, for example when the bag is filled with a relatively high amount of dirt, in particular because the soft and thin periphery can be easily bent. Thus, secure closing is ensured.

Material hardness can be, for example, Shore hardness. The retaining plate is embodied inside a vacuum cleaner to retain the vacuum cleaner filter bag. The retaining plate can in particular comprise a base plate in which the through-passage opening is formed. This base plate can be made of plastics. The closure flap can be attached to the base plate. The closure flap can be connected to the base plate by a hinge, for example an integral hinge.

The closure flap of the above described retaining flap can be integrally formed or comprise several partial flaps as they are shown, for example, in DE 202008004733. In the latter case, each partial flap can be connected to the base plate by a hinge.

The first and/or the second material could be plastics. The first material can be thermoplastics and/or the second material can be an elastomer. The second material can be, for example, a thermoplastic elastomer (TPE). The TPE can be olefin-based (TPE-O), cross-linked olefin-based (TPE-V), urethane-based (TPE-U), a styrene block copolymer (TPE-S), or a copolyamide (TPE-A). This permits an easy manufacture of the retaining plate. The second material can in particular be an elastomer-modified polypropylene. The second material can be embodied in the form of a foil.

The second material can have a hardness of 25 to 70 Shore A, preferably of at least 30 Shore A and/or at most 60 Shore A. The first material can have, for example, a hardness of 60 to 80 Shore D.

The second material can in particular have a thickness of less than 1 mm not only in part, but all over. Preferably, it can have, at least in part or all over, a thickness of 0.02 mm to 0.9 mm, in particular of 0.05 to 0.2 mm, further preferred of 0.1 to 0.2 mm. In particular if the second material is only in part within the stated thickness range, the region outside this thickness range can be at most 20%, preferably at most 10% of the area of the second region. For example, at most 20% of the area of the second region can comprise a thickness of 1 mm or more.

In the above described retaining plates, the first region can have a smaller area than that of the through-passage opening. This means in particular the area of the through-passage opening on the side of the retaining plate on which the closure flap rests in the closed position. The first region can at least in part overlap the second region. The area of the first region can be in particular at most 90%, preferably at most 80% of the area of the through-passage opening. If a sealing lip is in addition provided at the through-passage opening, the first region can also have a correspondingly smaller area than the area of the through-passage opening of the sealing lip.

In the above described retaining plates, the second region can be provided at least in part along the circumference or the periphery of the closure flap. Here, in particular at least 50%, preferably at least 70%, further preferred at least 90% of the circumference of the closure flap can be formed by the second material. For example, the complete circumference of the closure flap can also be formed by the second material; here, it is possible to omit the second material at most in the region of the hinge of the closure flap.

The second region can project beyond the first region along the circumference of the closure flap in part or completely by at least 3 mm, preferably at least 5 mm, further preferred at least 7 mm. In this manner, a flexible peripheral region for the closure flap of a width of at least 3 mm (in the radial direction) is obtained (at least where the periphery of the closure flap is formed by the second material).

The second region can project beyond the periphery of the through-passage opening when the through-passage opening is closed (that means in the closed position of the closure flap). The second region can be designed such that it rests at least in part on the base plate of the retaining plate when the through-passage opening is closed. The area of the closure flap can be larger than that of the through-passage opening.

The periphery of the first region can at least in part be spaced apart from the periphery of the through-passage opening in the closed position of the closure flap. The periphery of the first region can be completely spaced apart from the periphery of the through-passage opening, in particular except for the hinge or the hinge region.

The second region can comprise a plurality of sections separated by slots. The slots can in particular extend in the radial direction. The slots can in particular be embodied across the full width by which the second region projects beyond the first region. The slots can be spaced apart along the circumference of the closure flap by at least 1 mm, preferably at least 3 mm, further preferred at least 5 mm.

The second material can be fixed to the first material in front of or behind the latter in the closing direction of the closure flap. The first and the second material can be glued or welded to each other. As an alternative, the first and the second region (or the first and the second material) can be manufactured by means of a dual injection molding process.

The second region can be embodied to be flat or not flat in the open position of the closure flap. In the open position, it can be in particular shaped, for example like a key. In the open position, the second material can be, at least in part, inclined or bent in the direction of the through-passage opening (that means in the closing direction).

The area of the second region can be at least 20%, preferably at least 40%, further preferred at least 60% of the total area of the closure flap. As an alternative or in addition, the area of the first region can be at most 90%, preferably at most 70%, further preferred at most 50% of the total area of the closure flap.

The above described retaining plates can furthermore comprise a spring, wherein the closure flap is pretensioned in the closed position. The closure flap is then opened against the spring force.

The through-passage opening, the closure flap and/or the first region can be embodied to be round, in particular circular. The second region can comprise at least in part a circle, a portion of a circle, a segment of a circle, and/or a sector of a circle. The first region can comprise one or several bars, in particular in the radial direction, which in the closed position of the closure flap rest on the periphery of the through-passage opening. In particular if the second material is thickened at one or several points, one can do without the bars. At the thickened points, the second material can comprise a thickness above the previously stated thickness range.

The above described retaining plates can furthermore comprise a sealing lip, wherein the sealing lip is arranged in part or completely along the circumference of the through-passage opening.

The invention furthermore provides a vacuum cleaner filter bag, comprising one of the above described retaining plates. The vacuum cleaner filter bag can in particular be embodied in the form of a flat bag. The vacuum cleaner filter bag can comprise bag walls comprising one or several layers of non-woven and/or formed fabric.

The vacuum cleaner filter bag can furthermore comprise a non-woven material in the region of the inlet opening which prevents the formation of a filter cake, as it is described, for example, in EP2025278.

Figure 2:
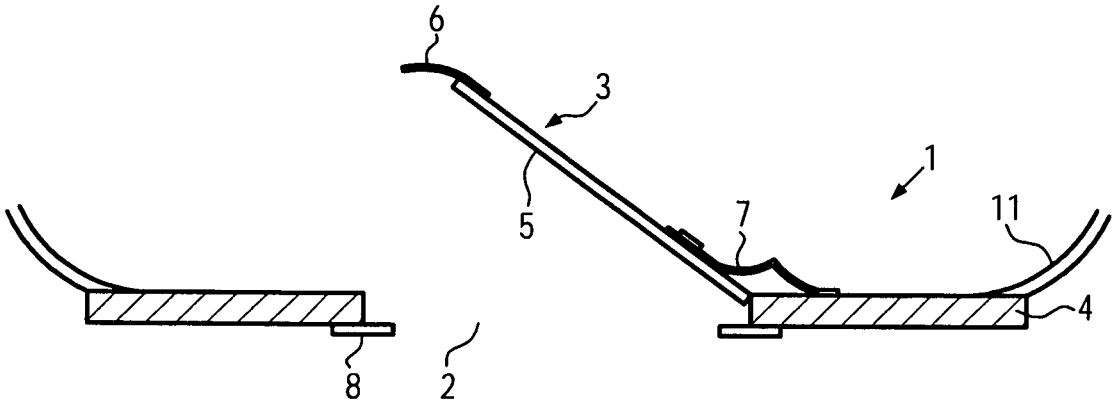
Figure 3:
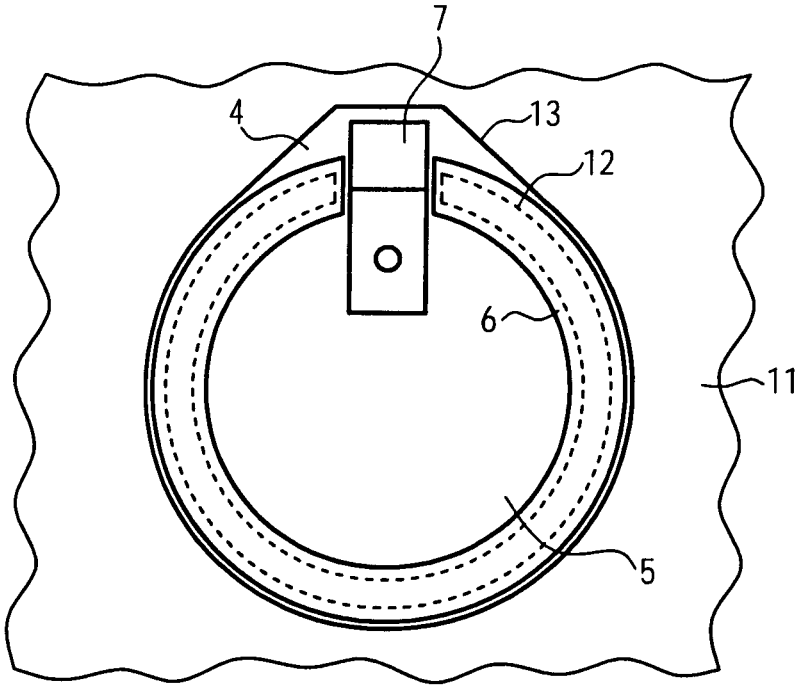
Figure 4:
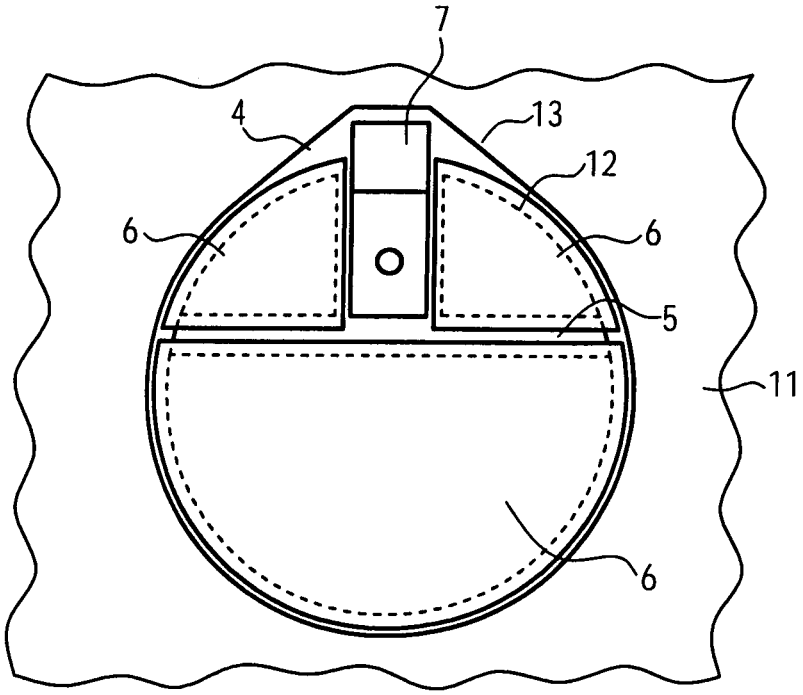
Figure 5:
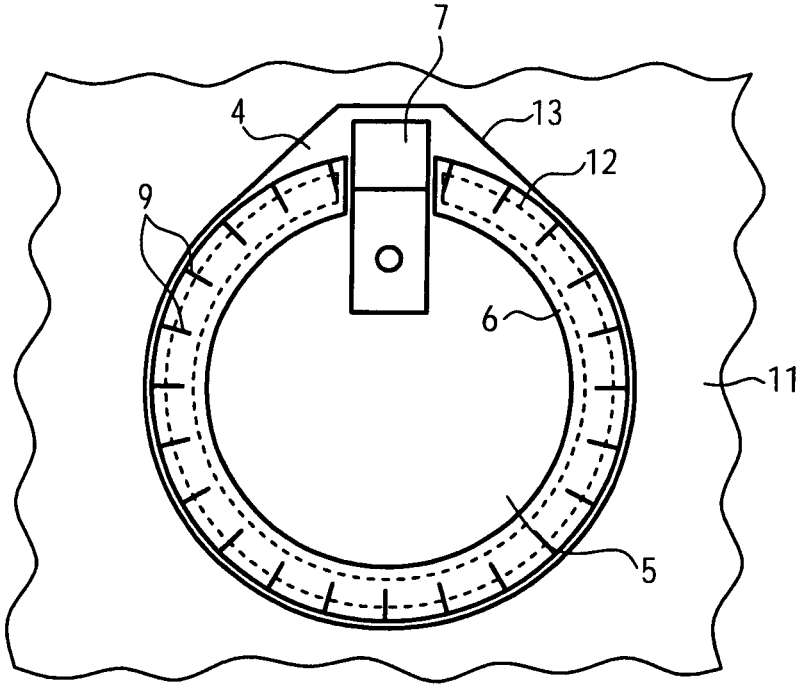
Figure 6:
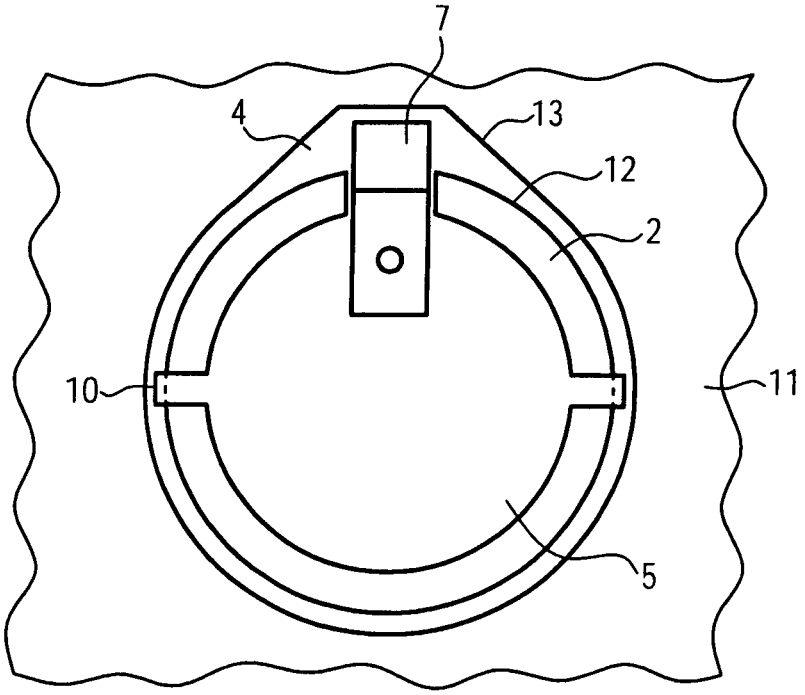

Further features and advantages will be described below with reference to the exemplary embodiments. The drawings schematically show:

FIG. 1 a cross-sectional view of an example of a retaining plate in the closed state;

FIG. 2 a cross-sectional view of an example of a retaining plate in the open state;

FIG. 3 a plan view from inside a vacuum cleaner filter bag onto an example of a closure flap;

FIG. 4 a plan view from inside a vacuum cleaner filter bag onto another example of a closure flap;

FIG. 5 a plan view from inside a vacuum cleaner filter bag onto another example of a closure flap;

FIG. 6 a plan view from inside the vacuum cleaner filter bag onto another example of a closure flap without the second material.

FIG. 1 shows a cross-sectional view of a schematic example of a retaining plate 1. In the retaining plate 1, a through-passage opening 2 is provided which can be closed by means of a closure flap 3. A corresponding closed state is shown in FIG. 1.

The closure flap 3 is connected with the base plate 4 of the retaining plate 1 via a hinge. The closure flap 3 comprises a first region 5 of a first material and a second region 6 of a second material. The base plate 4 of the retaining plate 1 is connected, for example welded, to the bag walls 11 of the vacuum cleaner filter bag.

The retaining plate furthermore comprises a spring 7 by which the closure flap is pretensioned in the closed position. In the shown example, this spring is firmly fixed to the closure flap on its one side, but can move along the base plate 4 on the other side.

As is illustrated in FIG. 2, the closure flap can be opened in the operation of the vacuum cleaner filter bag. While it is being opened, the closure flap moves towards the inside of the vacuum cleaner filter bag. Opening the closure flap can in particular be accomplished by means of the suction air flow; when the vacuum cleaner is switched off, the closure flap automatically closes again due to the spring force.

The retaining plate furthermore comprises a sealing lip 8 at its through-passage opening 2. This sealing lip 8 can be arranged at the base plate 4 in particular to surround the through-passage opening 2. The sealing lip functions to seal a connecting piece which is guided into the through-passage opening 2 and through which, in the operation of the vacuum cleaner filter bag, the sucked-in air enters the vacuum cleaner filter bag.

The base plate 4 and the closure flaps 3 with the regions 5 and 6 are preferably made of plastics. In particular the base plate and the first region 5 of the closure plate can be made of the same material; they can in particular be integrally formed (for example by means of injection molding). The hinge is embodied as integral hinge in the plastics.

The material of the base plate 4 and the first region 5 can be, for example, a polypropylene of a suited hardness (e.g. 70 Shore D) to retain the vacuum cleaner filter bag fixed to the retaining plate inside a vacuum cleaner. Next to the first region 5, the closure flap 3 comprises a second region 6 of a lower hardness. The second material of this second region is relatively thin. The thickness is below 1 mm and preferably between 0.05 mm and 0.9 mm. The hardness of the second material is preferably between 30 and 60 Shore A.

If the closure flap 3 closes or opens in the operation of the vacuum cleaner filter bag, the thin and soft peripheral region 6 permits a simple pivoting of the closure flap 3. In particular, this second region can be easily bent and thus permits to easily open and close the closure flap even if the bag is filled to a quite high degree and a corresponding filter cake has formed. If there are in addition dust particles in the region of the through-passage opening, the flexible second region will deform at the corresponding point, which otherwise, however, does not prevent the closure flap from closing.

As can be taken from FIGS. 1 and 2, the first region 5 of the closure flap 3 does not reach to the periphery 12 of the through-passage opening 2; the first region 5 thus has a smaller area than that of the through-passage opening 2. The second region 6 in contrast projects beyond the first region 5 and also beyond the periphery 12 of the through-passage opening 2; it extends over the base plate. This ensures a reliable closing of the through-passage opening 2. Preferably, the second region 6 projects beyond the first region 5 by at least 3 mm.

The second material is, for example, a thermoplastic elastomer, such as an elastomer-modified polypropylene. As an alternative, the second material can also be made of another plastics; other possibilities are the use of a rubber foil, formed fabric or paper. The second material can be welded or glued to the first material. As an alternative, the retaining plate can be prepared together with the closure plate in a dual injection molding process where the second material is injected to the first material.

Basically, the second region can be embodied to be flat and arranged in a plane parallel to the plane of the first region. In the example shown in FIG. 2, the second material is in contrast inclined away from the first material towards the through-passage opening. Such a shape improves the dust-tight closing of the through-passage opening.

The first and second regions can be embodied in many different ways. Examples of this are shown in FIGS. 3 to 5. These are each plan views onto the closure flap from inside the vacuum cleaner filter bag. In each of these embodiments, the second material is fixed to the first material behind the latter, seen in the closing direction of the closure flap. However, it is basically also possible for the second material to be arranged on the other side of the closure flap.

In the example shown in FIG. 3, the first region 5 has a circular design, as is indicated in a dashed line. The first region 5 is integrally formed with the base plate 4 and connected to the latter via an integral hinge.

Along the circumference of the first region 5, the flexible peripheral region 6 is provided in the form of a portion of a circle. This flexible region 6 on the one hand overlaps the first region 5 where it is glued to the latter, and on the other hand overlaps the through-passage opening in the closed state of the closure flap. In particular, the flexible peripheral element 6 extends beyond the periphery 12 (shown in a dashed line) of the through-passage opening. Except for the hinge region, here the second region 6 is provided along the complete circumference of the closure flap.

In this example, the area of the first region 5 is smaller than the area of the through-passage opening defined by the surrounding periphery 12. Furthermore, the periphery of the first region is completely spaced apart from the periphery 12 of the through-passage opening, except for the hinge region in the closed position.

The base plate 4 of the retaining plate is welded to the bag walls 11 of the vacuum cleaner filter bag along the weld seam 13.

In the example shown in FIG. 4, the second region 6 comprises three segments of a circle which are fixed to a T-shaped first region 5. The major portion of the area of the closure flap is here formed by the second material. In this embodiment, the area of the first region 5 is smaller than the area of the through-passage opening defined by the surrounding periphery 12. However, with its crossbar, the region 5 reaches to the periphery 12 and rests on the latter. Thus, even with a relatively high pretension of the spring 7, the closure flap is prevented from being further pressed into the through-passage opening by the spring in the closed state.

The example shown in FIG. 5 corresponds to the example of FIG. 3, wherein the second region now comprises a plurality of sections separated by slots 9. The advantage of the sections is that, despite a dirt particle being squeezed between the second material and the periphery of the through-passage opening when the closure flap is closed, a good sealing of the through-passage opening can be achieved.

FIG. 6 shows again a plan view onto a retaining flap seen from the inside of a vacuum cleaner filter bag. In this figure, the second material was omitted for better illustration. Similar to the example according to FIG. 3, the major portion of the first region 5 is embodied like a circle. As can be taken from FIG. 6, here, too, the area of the first region 5 is smaller than the area of the through-passage opening defined by the periphery 12. In this embodiment, the second region 5 does not extend to the periphery of the through-passage opening 2, except for two radially arranged bars 10.

In the closed position, the bars 10 are lying against the periphery 12 of the through-passage opening 2. It is thus prevented that the closure flap is further pressed into the through-passage opening 2 due to the spring force. Now a second, softer material, for example as shown in FIG. 3 or 5, can be fixed on the first region 5. Instead of the bars 10, the second material could also be thickened in parts (for example in a bar-shape) to ensure a corresponding abutment to the periphery of the through-passage opening. In this case, the first region 5 would not have to reach to the periphery of the through-passage opening 2 (except for the hinge region). Depending on the pretension of the spring 7, one can also do without the bars at the first material as well as thickenings in the second material.

Instead of the two bars shown in FIG. 6, only one bar or a higher number of bars can be alternatively provided.

In the illustrated embodiments, only one closure flap each is provided. As an alternative, the described features can also be applied to the case of two or more partial flaps, as they are shown, for example, in DE 20 2008 04 733. Each of the partial flaps would then be provided with the second material which is in particular arranged in the region where the partial flaps touch each other in the closed position.

The invention claimed is:

1. A retaining plate for a vacuum cleaner filter bag, comprising a base plate in which a through-passage opening is formed, and a closure flap for closing the through-passage opening, the closure flap is connected to the base plate by a hinge, and the closure flap comprises a first region, comprising a first material of a first hardness, and a second region, comprising a second material of a second hardness, the second hardness is less than the first hardness, the second region is arranged, at least in part, on a periphery of the closure flap, the second material, at least in part, has a thickness of less than 1 mm and the second region along a circumference of the closure flap outside an area of the hinge at least in part projects beyond the first region.

2. The retaining plate according to claim 1, wherein at least one of the first or the second material comprise plastic, wherein the first material is a thermoplastic or the second material an elastomer comprising a thermoplastic elastomer or wherein the first material is a thermoplastic and the second material is an elastomer comprising a thermoplastic elastomer.

3. The retaining plate according to claim 2, wherein the first material comprises a thermoplastic or the second material comprises an elastomer.

4. The retaining plate according to claim 1, wherein the second material has a hardness of 25 to 70 Shore A.

5. The retaining plate according to claim 4, wherein the second material has a harness of at least 30 Shore A or at most 60 Shore A.

6. The retaining plate according to claim 1, wherein the second material comprises a thickness of 0.02 mm to 0.9 mm.

7. The retaining plate according to claim 6, wherein the second material comprises a thickness of 0.05 to 0.2 mm.

8. The retaining plate according to claim 1, wherein the first region has a smaller area than an area of the through-passage opening.

9. The retaining plate according to claim 1, wherein the second region is provided at least partially along a circumference of the closure flap.

10. The retaining plate according to claim 9, wherein at least 50% of a circumference of the closure flap is formed by the second material.

11. The retaining plate according to claim 1, wherein the second region along a circumference of the closure flap at least in part projects beyond the first region by at least 3 mm.

12. The retaining plate according to claim 1, wherein the second region at least in part projects beyond the periphery of the through-passage opening when the through-passage opening is closed.

13. The retaining plate according to claim 1, wherein the second material is fixed to the first material in front of or behind the first material in a closing direction of the closure flap.

14. The retaining plate according to claim 1, wherein the second material is at least in part inclined towards the through-passage opening in an open position of the closure flap.

15. The retaining plate according to claim 1, wherein an area of the second region is at least 20%, of the total area of the closure flap.

16. The retaining plate according to claim 1, further comprising a spring, wherein the closure flap is pretensioned in a closed position.

17. The retaining plate according to claim 1, further comprising a sealing lip, wherein the sealing lip is arranged at least in part along a circumference of the through-passage opening.

18. The retaining plate according to claim 1, wherein the second region along the circumference of the closure flap at least in part projects beyond the first region by at least 5 mm.

19. A retaining plate for a vacuum cleaner filter bag, comprising a base plate in which a through-passage opening is formed, and a closure flap for closing the through-passage opening, the closure flap comprises a first region, comprising a first material of a first hardness, and a second region, comprising a second material of a second hardness, the second hardness is less than the first hardness, the second region is arranged, at least in part, on a periphery of the closure flap, the second material, at least in part, has a thickness of less than 1 mm and the second region along a circumference of the closure flap at least in part projects beyond the first region, and the second region comprises slots creating a plurality of sections.

20. A vacuum cleaner filter bag, comprising a bag wall comprising one or several layers of non-woven or formed fabric or non-woven and formed fabric, and a retaining plate, the retaining plate comprising a base plate in which a through-passage opening is formed, and a closure flap for closing the through-passage opening, the closure flap is connected to the base plate by a hinge, and the closure flap comprises a first region, comprising a first material of a first hardness, and a second region, comprising a second material of a second hardness, the second hardness is less than the first hardness, the second region is arranged, at least in part, on a periphery of the closure flap, the second material, at least in part, has a thickness of less than 1 mm and the second region along a circumference of the closure flap outside an area of the hinge at least in part projects beyond the first region.

* * * * *